US009537225B2

(12) United States Patent
Byun et al.

(10) Patent No.: US 9,537,225 B2
(45) Date of Patent: Jan. 3, 2017

(54) METHOD FOR USE WITH A REFLECTARRAY ANTENNA FOR WIRELESS TELECOMMUNICATION

(71) Applicant: Electronics and Telecommunications Research Institute, Daejeon (KR)

(72) Inventors: Woo Jin Byun, Daejeon (KR); Yong Heui Cho, Sejong-si (KR); Min Soo Kang, Daejeon (KR); Kwang Seon Kim, Daejeon (KR); Bong-Su Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 257 days.

(21) Appl. No.: 13/949,358

(22) Filed: Jul. 24, 2013

(65) Prior Publication Data

US 2014/0333503 A1 Nov. 13, 2014

(30) Foreign Application Priority Data

May 7, 2013 (KR) ..... 10-2013-0051272

(51) Int. Cl.
*H01Q 21/00* (2006.01)
*H01Q 21/06* (2006.01)
*H01Q 3/46* (2006.01)

(52) U.S. Cl.
CPC ..... *H01Q 21/065* (2013.01); *H01Q 3/46* (2013.01)

(58) Field of Classification Search
None
See application file for complete search history.

(56) References Cited

U.S. PATENT DOCUMENTS 3,806,946 A * 4/1974 Tiuri et al. ..... 343/731
6,930,639 B2 8/2005 Bauregger et al.
7,446,712 B2 * 11/2008 Itoh et al. ..... 343/700 MS
(Continued)

FOREIGN PATENT DOCUMENTS

KR 1020010076788 A 8/2001
KR 1020110123592 A 11/2011

OTHER PUBLICATIONS

Fabrizio Tamburini et al., "Encoding many channels on the same frequency through radio vorticity: first experimental test", New Journal of Physics, Mar. 1, 2012, pp. 1-17, vol. 14, No. 033001, IOP Publishing Ltd and Deutsche Physikalische Gesellschaft.

*Primary Examiner* — Trinh Dinh
(74) *Attorney, Agent, or Firm* — William Park & Associates Ltd.

(57) ABSTRACT

A method for use with a reflectarray antenna for wireless telecommunication is described. The method involves providing a reflectarray antenna, and adjusting a phase of a scattered field of the reflectarray antenna for generating different radiation patterns for angular mode-based multiplexing. The reflectarray antenna includes a ground plane, a dielectric substrate attached on the ground plane; and a first antenna patch formed on one side of the dielectric substrate. Further, the reflectarray antenna includes a second antenna patch formed adjacent to the first antenna patch with a separation area therebetween; and a phase adjustment member disposed in the separation area. The phase of the scattered field of the antenna is adjusted by changing a DC voltage of the phase adjustment member.

16 Claims, 9 Drawing Sheets

(56) References Cited

U.S. PATENT DOCUMENTS

| | | | | |
|---|---|---|---|---|
| 7,868,829 | B1 * | 1/2011 | Colburn | H01Q 3/46 343/700 MS |
| 2004/0227668 | A1 * | 11/2004 | Sievenpiper | 343/700 MS |
| 2004/0263420 | A1 * | 12/2004 | Werner | H01Q 1/38 343/909 |
| 2005/0200529 | A1 * | 9/2005 | Watanabe | H01Q 3/446 343/700 MS |
| 2007/0285316 | A1 * | 12/2007 | Saily et al. | 343/700 MS |
| 2008/0048917 | A1 * | 2/2008 | Achour et al. | 343/700 MS |
| 2008/0079649 | A1 * | 4/2008 | Mohamadi | 343/853 |
| 2008/0094296 | A1 * | 4/2008 | Lee | H01Q 19/06 343/754 |
| 2014/0035097 | A1 * | 2/2014 | Lin et al. | 257/531 |
| 2014/0225782 | A1 * | 8/2014 | Sanford | H01Q 21/0087 343/700 MS |

* cited by examiner

METHOD FOR USE WITH A REFLECTARRAY ANTENNA FOR WIRELESS TELECOMMUNICATION

CROSS-REFERENCE TO RELATED APPLICATION(S)

The present invention claims priority of Korean Patent Application No. 10-2013-0051272, filed on May 7, 2013, which is incorporated herein by reference.

FIELD OF THE INVENTION

The present invention relates to a reflectarray antenna for wireless telecommunication, and more particularly, to a reflectarray antenna and a structure thereof, which are capable of performing a phase modulation and signal reconstruction on phases of electric fields and magnetic fields with an azimuth angle and elevation angle which represent a rotation angle of a two-dimensional spherical surface perpendicular to a travelling direction of an electromagnetic wave so that same frequency and same polarization can be used for a signal multiplexing in ultra-high frequency band.

BACKGROUND OF THE INVENTION

There has been proposed various multiplexing techniques for increasing the efficiency of the communication channel. In recent, a MIMO (Multiple-Input Multiple-Output) technique is a method which combines multiple antennas and a signal processing technique in a transmitter and a receiver and is able to significantly increase the communication channel capacity by expanding the degree of the freedom of the communication channel even though there exist scatterers.

Also, proposed techniques that have different characteristics from the MIMO technique are an OAM (Orbital Angular Momentum) technique using the conservation of angular momentum and an angular mode-based multiplexing technique. These techniques enable to increase the communication channel capacity while even using a same frequency and a same polarization. Here, the OAM technique is a technique that has been proposed for light waves, and thus it requires various laser mode generation and a light wave synthesis technique. The angular mode-based multiplexing technique adjusts the phase of transmission or reception antenna and generates a rotation angle having the orthogonality that can be propagated on the three-dimensional space.

An antenna is an essential circuit element required for various multiplexing techniques that use the same frequency and the same polarization. The antenna must be able to adjust the phase of the electromagnetic wave radiation pattern for the expansion of the communication channel to receive or transmit signals simultaneously. Therefore, it is essential to provide a technique for efficiently controlling the phase of the array antenna elements.

FIG. 1 is an illustrative view of the structure of a unit cell of a reflectarray antenna that is primarily used in the development of a large-sized antenna. The reflectarray antenna uses a unit cell as an element of an array antenna to generate various antenna radiation patterns. For this purpose, the unit cell of a reflectarray is formed to an antenna patch 106 that is made of a metal on a dielectric substrate 104 having a ground plane 102.

SUMMARY OF THE INVENTION

In view of the above, the present invention provides an angular mode-based multiplexing technique which is one of the methods that generate an independent communication channel while having the same frequency and the same polarization.

In order to implement the angular mode-based multiplexing technique, the phase of the electromagnetic wave radiation pattern needs be rotated about a travelling direction as an axis with respect to an azimuth angle and an elevation angle. A behavior that the phase of a rotation angle is rotated is represented by an angular mode number. The angular mode number becomes an independent communication channel. However, since it is necessary to form a phase while sharing the same antenna, a transmitter and a receiver essentially require an array antenna capable of causing a phase change.

In accordance with a first aspect of the present invention, there is provided a reflectarray antenna for wireless telecommunication including a ground plane; a dielectric substrate attached on the ground plane; a first antenna patch formed on one side of the dielectric substrate; a second antenna patch formed adjacent to the first antenna patch with a separation area therebetween; a phase adjustment member disposed in the separation area to adjust a phase of a scattered field of the antenna by the appliance of a DC voltage.

Further, the first antenna patch and the second antenna patch may be arranged above and below with the separation area therebetween.

Further, the first antenna patch and the second antenna patch may be arranged right and left with the separation area therebetween.

Further, the phase adjustment member may comprise a diode.

Further, the phase of the scattered field may be adjusted by controlling the voltage to the diode.

Further, the first antenna patch and the second antenna patch may be same in their height.

Further, the first antenna patch and the second antenna patch may be different in their height.

Further, the phase of the scattered field may be adjusted by controlling the height of the first antenna patch and the second antenna patch.

Further, the apparatus may further comprise a metal pad formed to be spaced from the bottom of the ground plane; a first and a second conductive pillars configured to connect between the metal pad and the first and second antenna patches.

Further, the first and second conductive pillars may be formed by a via processing and a conductive material filling.

In accordance with a second aspect of the present invention, there is provided a reflectarray antenna structure having the reflectarray antenna arranged in an N×N array described above.

In accordance with a third aspect of the present invention, there is provided a reflectarray antenna for wireless telecommunication including: a ground plane; a dielectric substrate attached on the ground plane; an antenna patch group placed on the dielectric substrate, wherein the antenna patch group has a plurality of antenna patches arranged in an N×N array with separation areas between the antenna patches; and a plurality of phase adjustment members disposed in the separation areas to adjust a phase of a scattered field of the antenna by the appliance of a DC voltage.

Further, each of the phase adjustment members may comprise a diode.

Further, the phase of the scattered field may be adjusted by controlling the voltage to the diode.

Further, the respective antenna patches in the antenna patch group may be same in their height.

Further, the respective antenna patches in the antenna patch group may be different in their height.

Further, the phase of the scattered field may be adjusted by controlling the height of the respective antenna patches.

Further, the apparatus may further comprise a metal pad formed to be spaced from the bottom of the ground plane; a conductive pillar group configured to connect between the metal pad and the respective antenna patches in the antenna patch group.

Further, the respective conductive pillars may be formed by a via processing and a conductive material filling.

In accordance with a fourth aspect of the present invention, there is provided a reflectarray antenna structure having the reflectarray antenna arranged in an N×N array described above.

In accordance with an embodiment of the present invention, it is possible to design and manufacture transmission and reception antennas for implementing the angular mode-based multiplexing technique in the ultra-high frequency band where an available frequency band is almost saturated, which leads to significantly increase the communication channel capacity while using the same frequency and the same polarization, and thus effectively enhance the frequency use efficiency of the ultra-high frequency band.

BRIEF DESCRIPTION OF THE DRAWINGS

The above and other objects and features of the present invention will become apparent from the following description of the embodiments given in conjunction with the accompanying drawings, in which.

DETAILED DESCRIPTION OF THE EMBODIMENTS

Figure 1:
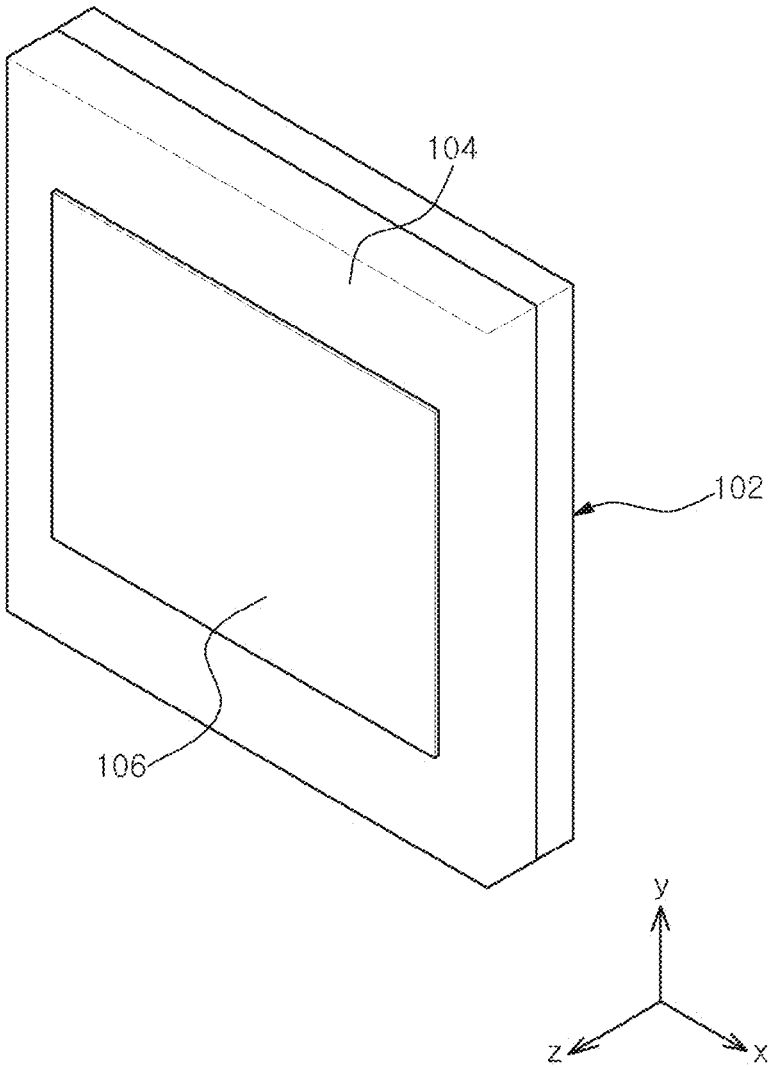
FIG. 1 (RELATED ART)
FIG. 1 shows a configuration of a unit cell of a reflectarray antenna that is primarily used in the development of a large-sized antenna in accordance with a related art.

Advantages and features of the invention and methods of accomplishing the same may be understood more readily by reference to the following detailed description of embodiments and the accompanying drawings. The invention may, however, be embodied in many different forms and should not be construed as being limited to the embodiments set forth herein. Rather, these embodiments are provided so that this disclosure will be thorough and complete and will fully convey the concept of the invention to those skilled in the art, and the invention will only be defined by the appended claims. Like reference numerals refer to like elements throughout the specification.

In the following description of the present invention, if the detailed description of the already known structure and operation may confuse the subject matter of the present invention, the detailed description thereof will be omitted. The following terms are terminologies defined by considering functions in the embodiments of the present invention and may be changed operators intend for the invention and practice. Hence, the terms need to be defined throughout the description of the present invention.

Hereinafter, the embodiments of the present invention will be described in detail with reference to the accompanying drawings.

Embodiment

Figure 2:
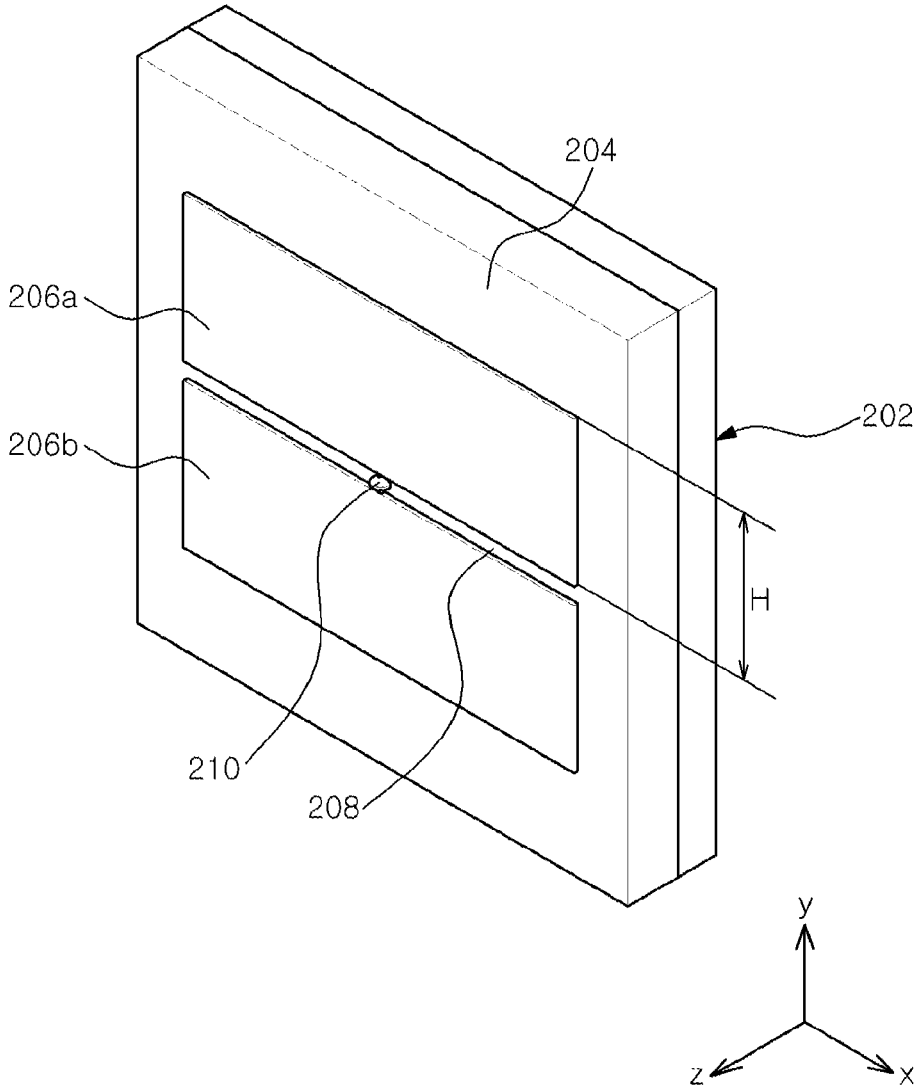
FIG. 2 shows a configuration of a unit cell of a reflectarray antenna having a diode disposed therein in order to implement an angular mode multiplexing technique in accordance with an embodiment of the present invention.

FIG. 2 shows a configuration of a unit cell of a reflectarray antenna having a diode disposed therein in order to implement an angular mode multiplexing technique in accordance with an embodiment of the present invention. The reflectarray antenna of the embodiment includes a ground plane 202, a dielectric substrate 204 which is attached on the ground plane 202, a first antenna patch 206*a* formed on one side of the dielectric substrate 204, a second patch antenna 206*b* formed on the other side of the dielectric substrate 204 adjacent to the first antenna patch 206*a* with a separation area 208 between the first and second antenna patches, and a phase adjustment member 210 which is disposed in the separation area 208 to adjust a phase of a scattered field of the antenna by applying a DC voltage. Here, the first and the second patch antennas 206*a* and 206*b* may be defined as a patch antenna to perform a radiant and irradiation function of the antenna.

Referring to FIG. 2, while it has been shown and described that the first antenna patch 206*a* and the second antenna patch 206*b* are arranged above and below, respectively, with the separation area 208 therebetween, the embodiment is not limited thereto. Alternatively, as necessary or depending on its use, the first antenna patch 206*a* and the second antenna patch 206*b* may be arranged right and left, respectively, with the separation area 208 therebetween.

The phase adjustment member 210 may be a diode, for example. The reflectarray antenna of the embodiment adjusts the phase of the scattered field of the antenna using a controlled voltage to the diode.

The first antenna patch 206*a* and the second antenna patch 206*b* may be configured to have the same height or different height. In this embodiment, the reflectarray antenna may adjust the phase of the scattered field by controlling the height of the first antenna patch 206*a* and the second antenna patch 206*b*.

The unit cell of the embodiment has primarily a patch configuration and is composed of the two antenna patches 206*a* and 206*b* on the dielectric substrate 204 having the ground plane 202. Although the unit cell of the embodiment looks like the unit cell shown in FIG. 1, the unit cell of the embodiment is different from the unit cell shown in FIG. 1 in that it has elongated grooves in vertical (conductive pillars) (see FIG. 4) formed in the centers of the first antenna patch 206*a* and the second antenna patch 206*b* and the phase adjustment member 210, i.e., a diode, which is disposed in the separation area 208 and used to couple the first antenna patch 206*a* and the second antenna patch 206*b*.

The diode which serves as the phase adjustment member 210 exhibits a function relationship that an internal capacitance follows Equation 1 depending on the voltage applied to an anode electrode and a cathode electrode. That is, the change in the voltage leads to alter the internal capacitance.

$$C_D = f(V_D) \quad \text{Eq. 1}$$

where $C_D$ denotes an internal capacitance of the diode, $V_D$ denotes the voltage applied to an anode electrode and a cathode electrode of the diode.

Figure 3:
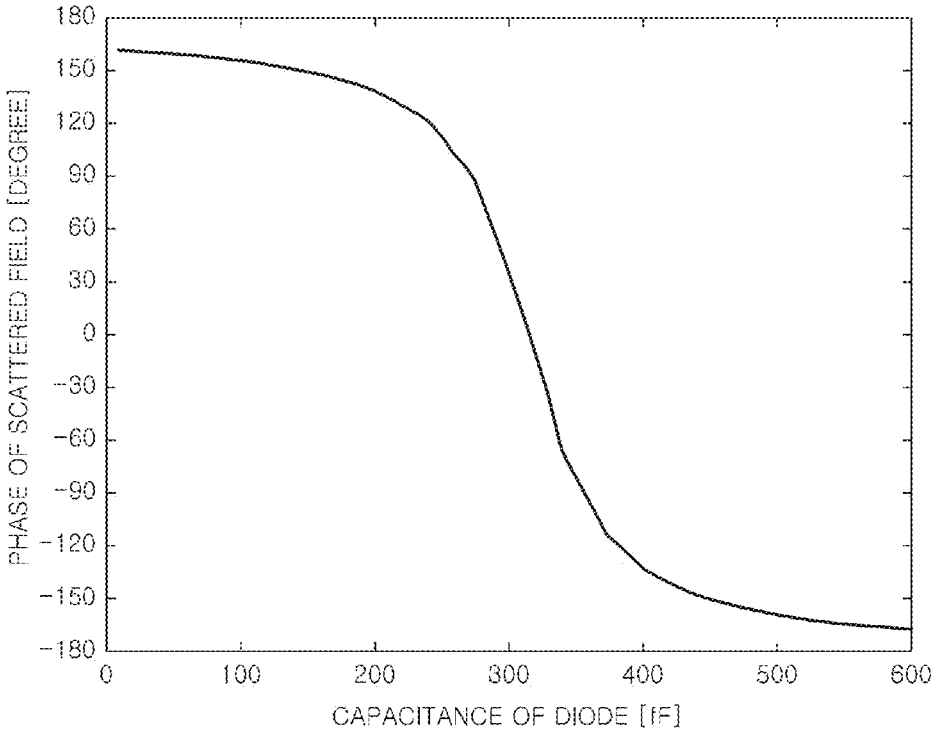
FIG. 3 is a graph illustrating a feature of a phase change in a unit cell of a reflectarray antenna for the angular mode multiplexing technique to an internal capacitance of a diode.

FIG. 3 is a graph illustrating a feature of a phase change in a unit cell in a reflectarray antenna for an angular mode multiplexing technique to an internal capacitance of the diode.

Referring to FIG. 3, when the DC voltage applied to the unit cell is changed, it leads to alter the internal capacitance of the diode, which results in inverting the phase of the scattered field nearly to −180~+180 degrees. That is, the change in the DC voltage causes the change in the phase of the scattered field, which results in generating various antenna radiation patterns. To accomplish it, the first antenna patch 206*a* and the second antenna patch 206*b* shown in FIG. 2 may be configured to have the same height, or to have different height for the purpose of improving a bandwidth feature, to thereby get the feature of the DC voltage—the phase of the scattered field as illustrated in FIG. 3.

Figure 4:
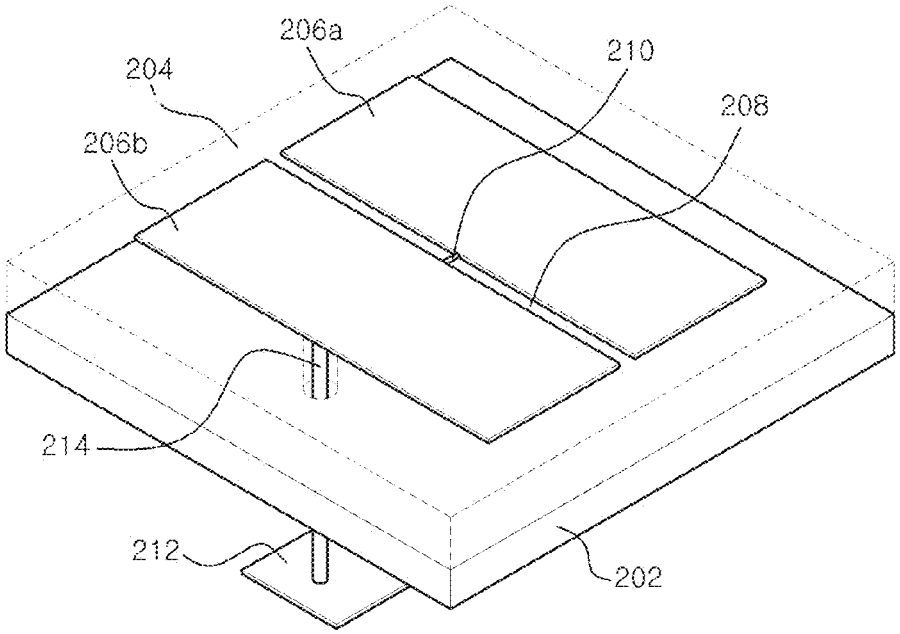
FIG. 4 shows a bias configuration for applying a DC voltage to a diode disposed within a unit cell.

FIG. 4 shows a bias configuration for applying a DC voltage to a diode disposed within a unit cell.

Referring to FIG. 4, there is illustrated a bias configuration for applying the DC voltage to the diode which is the phase adjustment member 210 within the unit cell. In order to apply a DC voltage, a via processing is conducted in the dielectric substrate 204 to form a hole in the center of the dielectric substrate passing through the ground plane 202, and a conductive material is buried in the hole to form a conductive pillar 214 through which the DC voltage is applied, to thereby physically connect between the first antenna patch 206*a* and a metal pad 212 through the conductive pillar 214.

Consequently, the bias voltage to the diode can be changed by applying the DC voltage to the metal pad 212 behind the unit cell through this configuration.

Although it is illustrated in FIG. 4 that one conductive pillar is formed to connect between the second antenna patch 206*b* and the metal pad 212, it is understood that two conductive pillars are formed to connect the first and second antenna patches 206*a* and 206*b* and the metal pad 212 and they may be formed simultaneously by a via processing and a conductive material filling.

Figure 5:
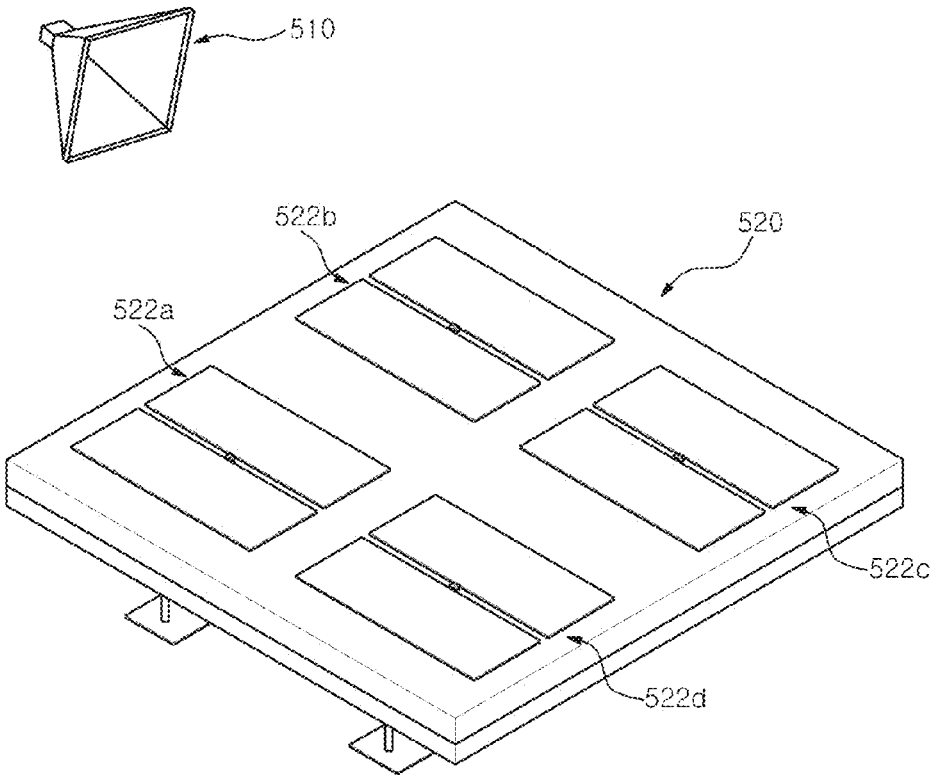
FIG. 5 depicts a configuration of a reflectarray antenna structure for wireless telecommunication arranged in a 2×2 array in accordance with an embodiment of the present invention.

FIG. 5 depicts a configuration of a reflectarray antenna structure for wireless telecommunication arranged in a 2×2 array in accordance with an embodiment of the present invention. Referring to FIG. 5, the reflectarray antenna structure 520 has a configuration in which a plurality of reflectarray antennas 522*a*, 522*b*, 522*c* and 522*d* as illustrated in FIG. 2 are arranged in an N×N array on the dielectric substrate. Here, it will be understood that the N×N array may be a variety of arrays such as a 2×2 array as well as 2×3, 3×2, 3×3, 3×4, 4×3, 4×4, . . . and so on, if necessary or depending on its use.

Referring to FIG. 5, each of the reflectarray antennas 522*a* to 522*d* is composed of 2×2 elements. The electromagnetic wave signal emitted from a feeder 510 is scattered by the respective elements to re-radiate in a forward direction. In order to adjust the phase of the electromagnetic wave being scattered, the bias configuration shown in FIG. 4 is used to control the voltage to the diodes, thereby changing the internal capacitance of the diodes.

Figure 6:
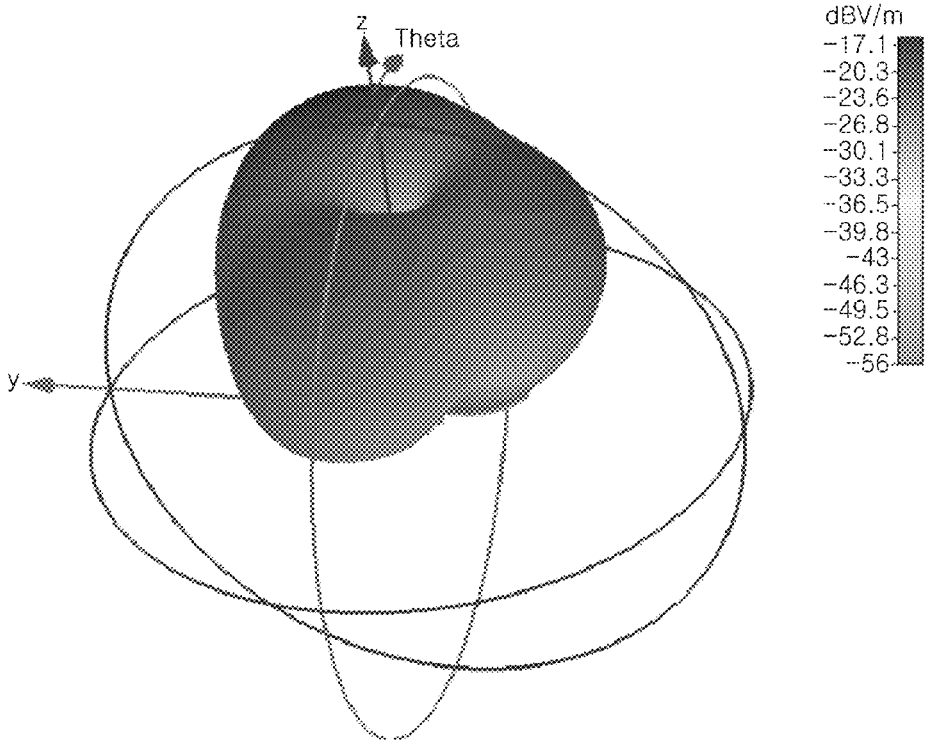
FIG. 6 is a graph illustrating a magnitude of a radiation pattern of a reflectarray antenna arranged in a 3×3 element having diodes.

FIG. 6 is a graph illustrating a magnitude of a radiation pattern of the reflectarray antenna arranged in a 3×3 element having diodes.

Referring to FIG. 6, an angular mode antenna beam which has a mode number of 1 in an azimuth angle direction $\phi$ was generated by rotating the phase of each 3×3 element in sequence. It can be seen that the radiation pattern of the antenna at a point of $\theta=0$ becomes zero (0) since the phase of the electromagnetic wave is rotating about z-axis that is a traveling direction.

Figure 7:
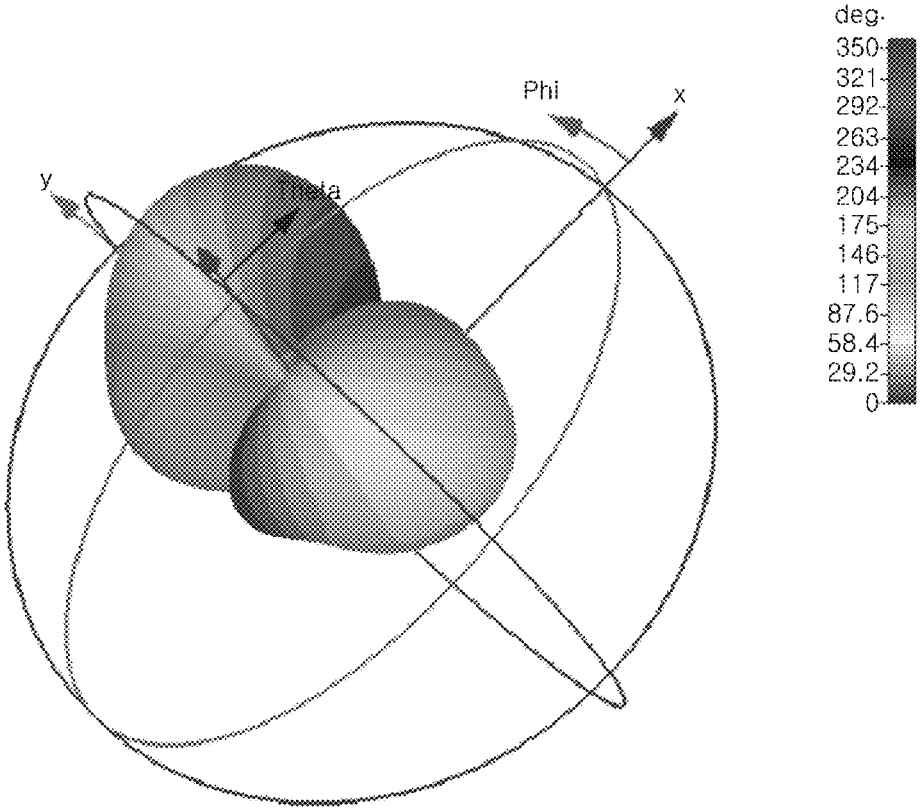
FIG. 7 is a graph illustrating a phase feature in a vector $\hat{\theta}$ direction of a reflectarray antenna arranged in a 3×3 element having diodes an elevation angle θ.

FIG. 7 is a graph illustrating a phase feature in vector $\hat{\theta}$ direction of a reflectarray antenna arranged in a 3×3 element having diodes at an elevation angle $\theta$.

Referring to FIG. 7, the unit cell shown in FIG. 2 has a polarization direction of the y-axis and thus the vector $\hat{\theta}$ direction at an elevation angle $\theta$ needs be observed near the azimuth angle $\phi=90°$ and 270°. Accordingly, it is observed that the phase of the electromagnetic wave is being changed sequentially near the azimuth angle $\phi=90°$ and 270°.

Figure 8:
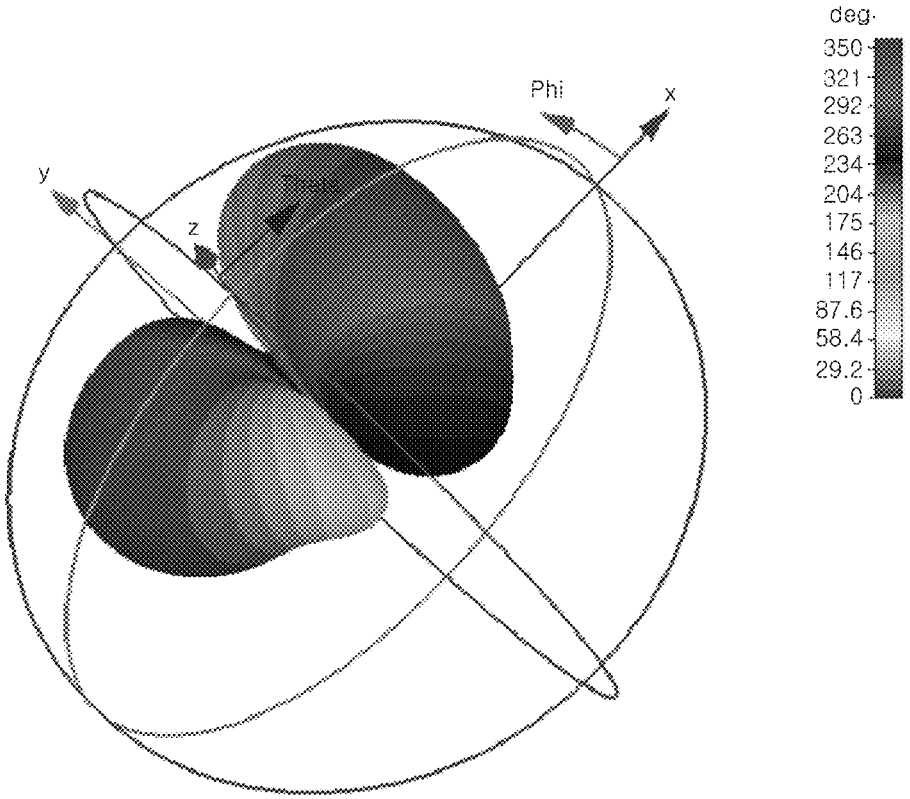
FIG. 8 is a graph illustrating a phase feature in a vector $\hat{\phi}$ direction of a reflectarray antenna arranged in a 3×3 element having diodes at an azimuth angle.

FIG. 8 is a graph illustrating a phase feature in a vector $\hat{\phi}$ direction of a reflectarray antenna arranged in a 3×3 element having diodes at an azimuth angle $\phi$.

Referring to FIG. 8, as similar to FIG. 7, the unit cell has a polarization direction of the y-axis and thus the vector $\hat{\phi}$ direction at an azimuth angle $\phi$ needs be observed near the azimuth angle $\phi=0°$ and 180°. As similar to FIG. 7, it can be seen that the phase of the electromagnetic wave near the azimuth angle $\phi=0°$ and 180°; and $\phi=90°$ and 270° is being changed with a feature of a mode number 1 sequentially.

Figure 9:
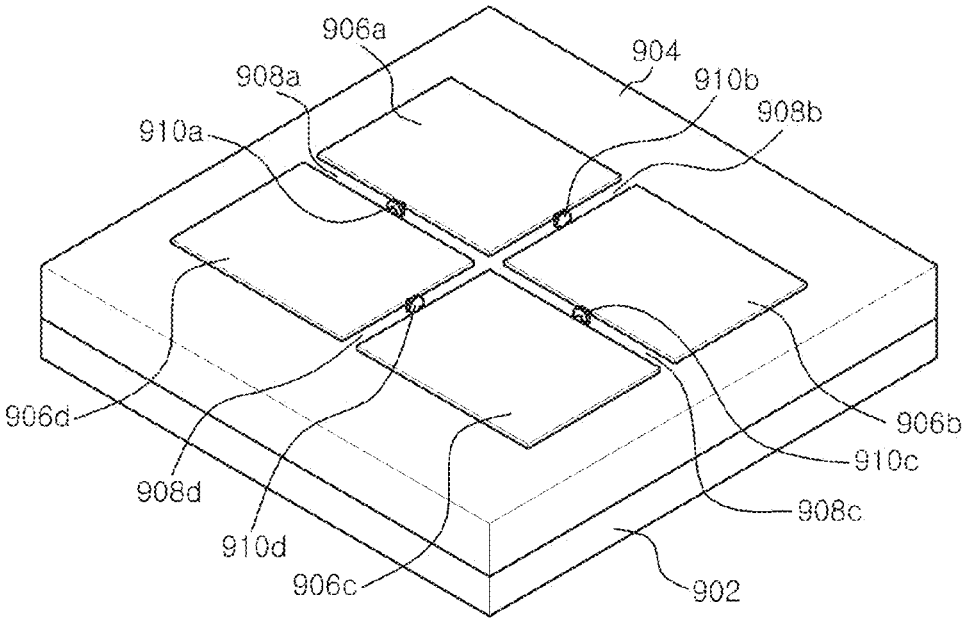
FIG. 9 shows a configuration of a unit cell of a reflectarray antenna for wireless telecommunication into which diodes are disposed in order to implement an angular mode multiplexing technique in accordance with another embodiment of the present invention.

FIG. 9 shows a configuration of a unit cell of a reflectarray antenna for wireless telecommunication in which diodes are disposed in order to implement an angular mode multiplexing technique in accordance with another embodiment of the present invention.

Referring to FIG. 9, the reflectarray antenna of the embodiment includes a ground plane 902, a dielectric substrate 904 which is attached on the ground plane 902, an antenna patch group which has a plurality of antenna patches 906*a*, 906*b*, 906*c*, and 906*d* arranged in an N×N array (e.g., a 4×4 array) with separation areas 908*a*, 908*b*, 908*c* and 908*d*, respectively, between the antenna patches, and a plurality of phase adjustment members 910*a*, 910*b*, 910*c* and 910*d* which are disposed in the separation areas 908*a*, 908*b*, 908*c* and 908*d*, respectively, to adjust a phase of the scattered field of the antenna by applying a DC voltage. Here, the respective patch antennas 906*a* to 906*d* in the antenna patch group may be defined as a patch antenna to perform a radiation and irradiation function of the antenna.

Further, the respective patch antennas 906*a* to 906*d* comprised of the antenna patch group may be configured to have the same height or different height. In this embodiment, the reflectarray antenna may adjust the phase of the scattered field by controlling the height of the respective antenna patches 906*a* to 906*b*.

The respective phase adjustment members 910*a* to 910*d* may be a diode, for example. The reflectarray antenna of the embodiment adjusts the phase of the scattered field of the antenna using a controlled voltage to the diodes.

Further, although it is not shown in FIG. 9 in detail, the reflectarray antenna of the embodiment may further include a conductive pillar group composed of a plurality of conductive pillars that are formed to physically connect between the metal pad that is formed to be spaced by a predetermined distance from a lower end of the ground plane 902 and the respective antenna patches in the antenna patch group, and the respective conductive pillars may be formed simultaneously by a via processing and a conductive material filling.

To put it another way, the present embodiment of the invention includes a unit cell structure of a reflectarray antenna in which diodes (phase adjustment members) are disposed in x-axis and y-axis in order to implement the angular mode multiplexing technique having x-axis and y-axis polarizations wherein antenna patches 906*a* to 906*d* are divided by thin grooves (i.e., separation areas) along the x-axis and y-axis. Four antenna patches 906*a* to 906*d* may have the same width and height or different width and height in consideration of the bandwidth feature.

In accordance with the embodiments of the present invention, the unit cell illustrated in FIG. 2 is able to reflect the y-axis polarization in a desired phase, and the unit cell in this embodiment has diodes disposed in x-axis and y-axis direction and thus is able to scatter the electromagnetic wave having x-axis and y-axis polarizations in a desired phase. Consequently, the use of the unit cell of this embodiment leads to the generation of radiation patterns of the angular mode in both x-axis and y-axis polarizations. Accordingly, the unit cell in this embodiment may exhibit the twice increase of the communication channel capacity compared to the unit cell illustrated in FIG. 2.

Further, the reflectarray antenna in accordance with an embodiment of the present invention may be implemented as a reflectarray antenna structure for wireless telecommunication which has a configuration that a plurality of reflectarray antennas as described above are arranged in an N×N array on the dielectric substrate.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A reflectarray antenna for wireless telecommunication, comprising:

a ground plane;

a dielectric substrate attached on the ground plane;

a first antenna patch formed on one side of the dielectric substrate;

a second antenna patch formed adjacent to the first antenna patch with a separation area therebetween; and a phase adjustment member disposed in the separation area, wherein each of the first antenna patch and the second antenna patch is connected only to the phase adjustment member, and configured to adjust a phase of a scattered field of the reflectarray antenna in accordance with a DC voltage applied to the reflectarray antenna such that different angular mode radiation patterns are generated for transmitting and receiving signals by multiplexing and demultiplexing.

2. The reflectarray antenna of claim 1, wherein the first antenna patch and the second antenna patch are arranged above and below with the separation area therebetween.

3. The reflectarray antenna of claim 1, wherein the first antenna patch and the second antenna patch are arranged right and left with the separation area therebetween.

4. The reflectarray antenna of claim 1, wherein the phase adjustment member comprises a diode.

5. The reflectarray antenna of claim 4, wherein the phase of the scattered field is adjusted by controlling the voltage to the diode.

6. The reflectarray antenna of claim 1, wherein the first antenna patch and the second antenna patch are same in their height.

7. The reflectarray antenna of claim 1, further comprising:

a metal pad formed to be spaced from the bottom of the ground plane; and a first and a second conductive pillars configured to connect between the metal pad and the first and second antenna patches.

8. The reflectarray antenna of claim 7, wherein the first and second conductive pillars are formed by a via processing and a conductive material filling.

9. A reflectarray antenna structure having the reflectarray antenna of claim 1, wherein the reflectarray antenna is arranged in an N×N array.

10. A reflectarray antenna for wireless telecommunication, comprising:

a ground plane;

a dielectric substrate attached on the ground plane;

an antenna patch group placed on the dielectric substrate, wherein the antenna patch group has a plurality of antenna patches arranged in an N×N array with separation areas between the antenna patches; and a plurality of phase adjustment members disposed in the separation areas, wherein each antenna patch of the plurality of antenna patches is connected only to a single one of the plurality of phase adjustment members, and configured to adjust a phase of a scattered field of the reflectarray antenna in accordance with a DC voltage applied to the reflectarray antenna such that different angular mode radiation patterns are generated for transmitting and receiving signals by multiplexing and demultiplexing, wherein each antenna patch has a single phase adjustment member connection thereto.

11. The reflectarray antenna of claim 10, wherein each of the phase adjustment members comprises a diode.

12. The reflectarray antenna of claim 11, wherein the phase of the scattered field is adjusted by controlling the voltage to the diode.

13. The reflectarray antenna of claim 10, wherein the respective antenna patches in the antenna patch group are same in their height.

14. The reflectarray antenna of claim 10, further comprising:

a metal pad formed to be spaced from the bottom of the ground plane;

a conductive pillar group configured to connect between the metal pad and the respective antenna patches in the antenna patch group.

15. The reflectarray antenna of claim 14, wherein the respective conductive pillars are formed by a via processing and a conductive material filling.

16. A reflectarray antenna structure having the reflectarray antenna of claim 10, the reflectarray antenna being arranged in an N×N array.

* * * * *